United States Patent [19]

Shoults

[11] 4,011,880

[45] Mar. 15, 1977

[54] TENT STRUCTURE

[76] Inventor: Glen E. Shoults, 421 W. Elm St., Hartford City, Ind. 47348

[22] Filed: Sept. 11, 1975

[21] Appl. No.: 612,327

[52] U.S. Cl. ..... 135/1 C; 135/3 B; 135/4 C; 135/15 PQ

[51] Int. Cl.[2] ..... A45F 1/16

[58] Field of Search ..... 135/1 C, 1 D, 3 B, 3 C, 135/4 B, 4 C, 15 PQ, 15 CF, 15 PE; 24/68 CD

[56] References Cited

UNITED STATES PATENTS

| | | | |
|---|---|---|---|
| 34,258 | 1/1862 | Lynch | 135/4 C |
| 758,642 | 5/1904 | Gotsche | 135/15 PE |
| 842,672 | 1/1907 | Kirby | 135/3 B |
| 974,491 | 11/1910 | Huebner | 135/4 C |
| 1,730,565 | 10/1929 | Flintjer | 135/15 PO |
| 2,314,830 | 3/1943 | Hunter | 135/1 D |
| 2,512,099 | 6/1950 | Guenzl | 135/4 C |
| 3,251,370 | 5/1966 | Tanner | 135/1 C |

FOREIGN PATENTS OR APPLICATIONS

| | | | |
|---|---|---|---|
| 299,258 | 10/1928 | United Kingdom | 135/15 PQ |

*Primary Examiner*—Werner H. Schroeder
*Assistant Examiner*—Conrad L. Berman
*Attorney, Agent, or Firm*—Gust, Irish, Jeffers & Rickert

[57] ABSTRACT

A tent structure having a plurality of elongate tent staves pivotably joined to a common pin at one of their respective ends and supportable at their distal ends on a tent supporting surface. A tent cover is fitted over the staves and defines a tent enclosure when the staves are pivoted outwardly against the cover. A tensile strand depends from the pin and is attached to the supporting surface. A tensioning device adjusts the tensile stress in the strand.

3 Claims, 10 Drawing Figures

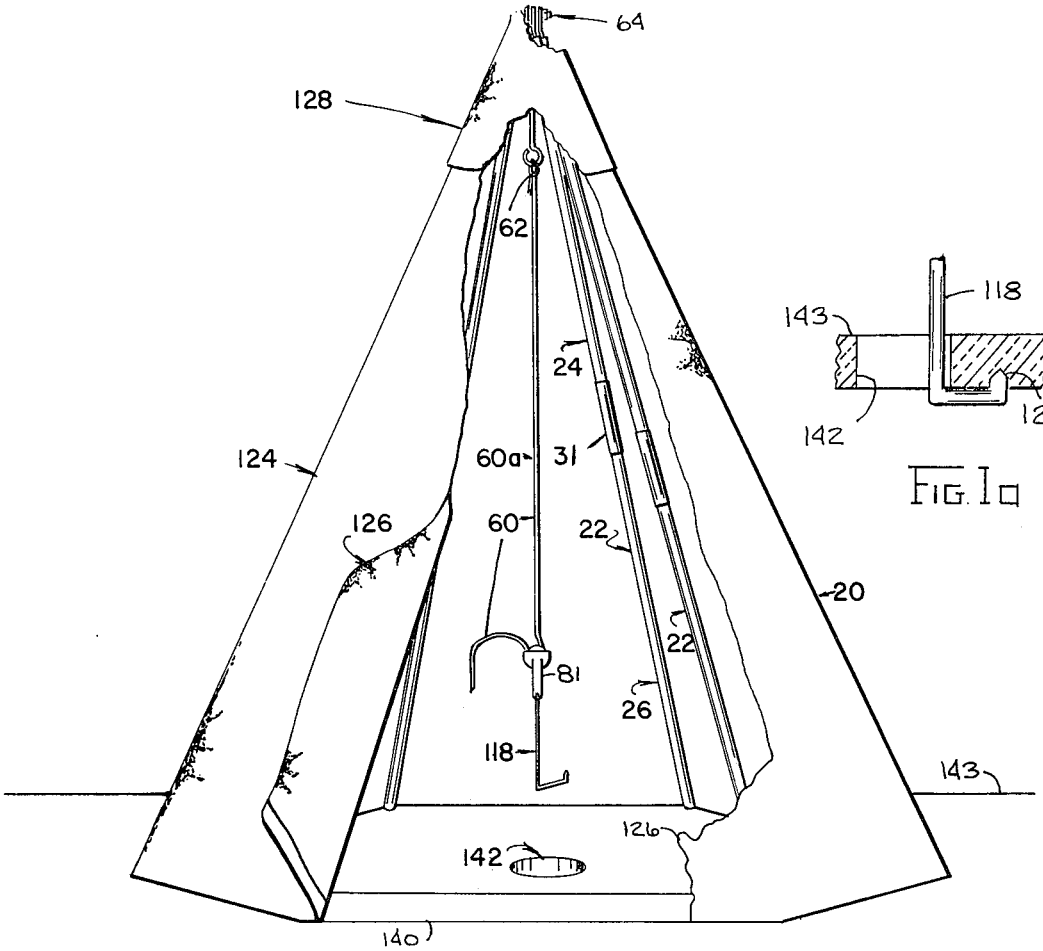
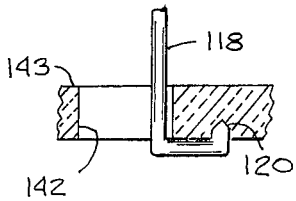
FIG. 1a
FIG. 1
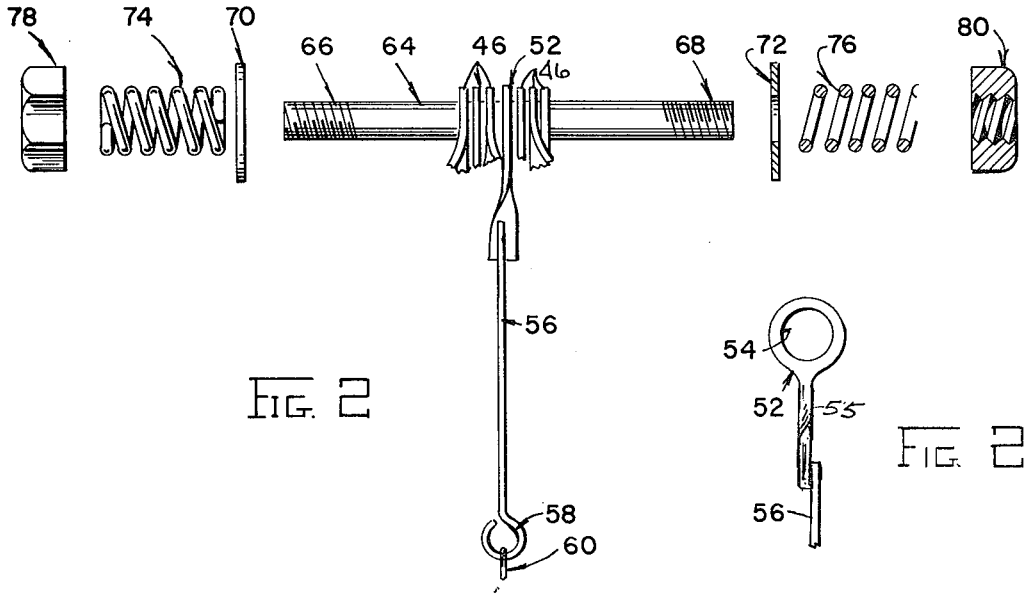
FIG. 2
FIG. 2a

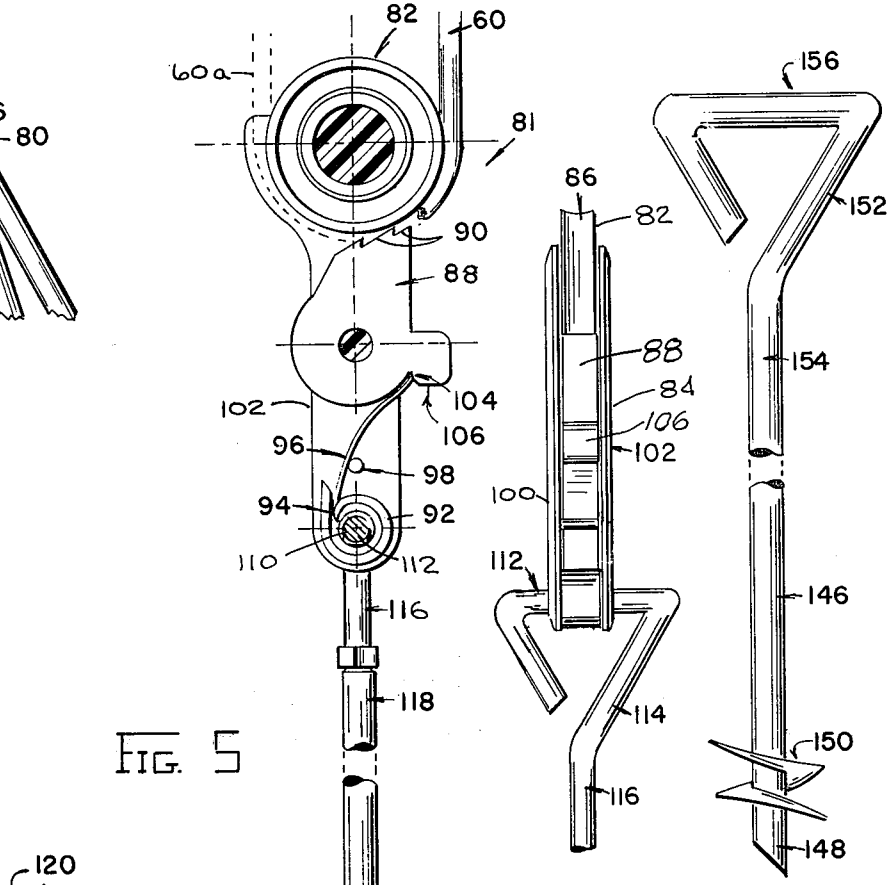
FIG. 6
FIG. 5a
FIG. 5
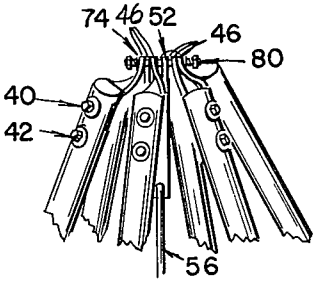
FIG. 3a
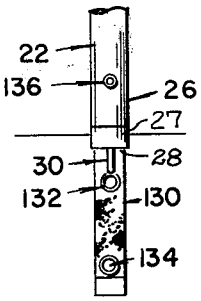
FIG. 4
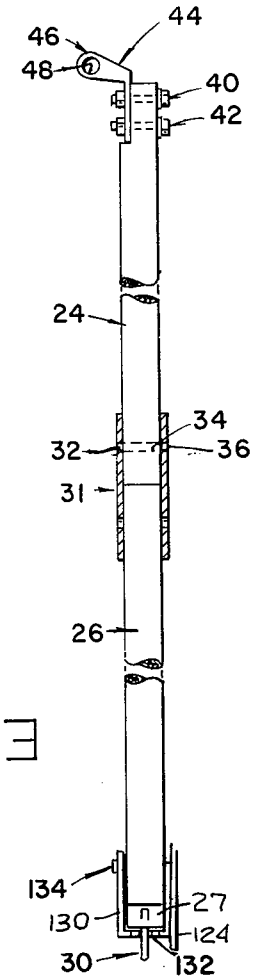
FIG. 3

TENT STRUCTURE

BACKGROUND OF THE INVENTION

1. Field of the Invention

The invention pertains to portable tents and, more particularly, to conical or tepee tents that may be erected on an ice surface as well as a ground surface.

2. Brief Description of the Prior Art

Tents are one of the oldest known forms of shelter from and protection against the elements. Tent constructions have strived to combine portability, ease of erection, sturdiness and stability, which is especially important in those tents designed for use on ice and/or in exceptionally windy locales. Efforts have been made to place tensile and compressive forces on the tent frame members to accomplish the above but have resulted in constructions having numerous tent cords and stakes which make tent erection difficult and time consuming and are not suitable for erection on an ice surface.

SUMMARY OF THE INVENTION

A tent frame is constructed of a plurality of elongate staves, each of which has a bracket fastened at one end and spikes extending longitudinally from the distal ends. A pin is placed through openings in each of said brackets and resilient fastening means hold the brackets on the pin. A tent cover is placed over the staves and is provided with snap straps which have eyelets through which the spikes are inserted. The straps are then snap fastened to the staves. The staves are pivoted outwardly against the confines of the cover which then defines a tent enclosure. The spikes pierce the tent supporting surface to position the tent thereon.

A tensile strand depends from the pin centrally of the tent enclosure and is connected to the tent supporting surface. When the supporting surface is ice, a hole is cut in the ice and the strand is fastened to a "J" shaped hook which is inserted through the hole. The hook has an upwardly projecting sharpened end for gripping the underside of the ice. A tensioning device is provided in the strand to adjustably apply tension to the strand, placing a compressive force on the staves to hold them in stabilized position on the ice. When the supporting surface is ground, an elongate metal auger rod is turned into the ground and the strand is fastened to an eye at the exposed rod end prior to application of the tensile force.

It is an object of this invention to provide a portable tent structure that is easily erected, sturdy, and stable whether erected on an ice or ground surface.

It is an object to provide in a tent structure of the foregoing object a tensile stabilizing member for providing tensile compressive forces in the tent frame for increased stability.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a tent construction of this invention with the tent cover shown partially broken away and the tent cap shown partially broken away;

FIG. 1A is a view in section of the tensioner hook engaged with the underside of the ice surface;

FIG. 2 is an exploded view of the bracket pin assembly; the pin shown inserted through the bracket eyes, the brackets being partially shown;

FIG. 2A is a side view of the tensioner connector;

FIG. 3 is a view of a tent stave;

FIG. 3A is a perspective view of the assembled stave bracket ends;

FIG. 4 is a partial view of the lower end of a tent stave prior to fastening of the tent cover strap thereto;

FIG. 5 is a view of the rope tensioner device in section and a broken view of the ice hook for use in an ice tent embodiment of this invention;

FIG. 5A is an end view of a rope tensioner device; and

FIG. 6 is a broken view of an auger for use in a ground tent embodiment of this invention.

DESCRIPTION OF A PREFERRED EMBODIMENT

Referring to FIGS. 1 to 3A, a tent 20 has six tent staves 22 each of which comprises an upper elongate section 24 and a lower elongate section 26. The lower section 26 has extending from the distal end 28 thereof a spike 30 having a sharpened exposed end for gripping the ice or ground of the supporting surface. The upper section 24 has attached at the lower end thereof a cylindrical sleeve 31, which is of a metallic or other rigid material, which has diametrically opposite holes 32 formed therein. A transverse hole 34 is formed in the lower end of section 24 and a pin 36 is inserted through holes 32 and 34 of the sleeve 31 and section 24 respectively and is secured to the sleeve 31 as with a friction fit. The upper end of section 24 has attached thereto by means of bolts 40 and 42 a bracket 44 which has extending therefrom an arm 46 at the end of which is a pin opening 48. The lower ends of each section 26 has a ferrule 27 to prevent splintering and the like. Each stave 22 is similarly constructed, the arms 46 being angled corresponding to their assembled positions on pin 64 to provide the proper swing out during tent erection, as explained below.

An eye connector 52, FIGS. 2 and 2A, has an eye opening 54 formed at one end thereof and a shank 55 which is welded or otherwise secured to depending rod 56. Shank 55 is twisted relative the plane of opening 54 to facilitate closing of the staves 22 in their assembled state. Rod 56 has formed at the lower end thereof circular openings 58 for rope 60 which is passed therethrough and secured thereto by forming a rope knot or in any suitable manner.

A transverse pin 64 is threaded at ends 66 and 68. Washers 70 and 72, helical springs 74 and 76, and nuts 78 and 80 are adapted for placement over pin ends 66 and 68, respectively, with nuts 78 and 80 adapted for threaded engagement with the threaded ends 66 and 68, respectively. Connector 52 is placed on pin 64 and the bracket arms 46 of three staves 22 are placed on pin 64 on either side of connector 52. Washers 70 and 72, springs 74 and 76, and nuts 78 and 80 are then assembled on pin 64 resulting in the assembly of FIG. 3A.

Referring now to FIGS. 5 and 5A, a tensioner 81 for rope 60 will be described. A pulley 82 is rotatably mounted between spaced parallel walls 100 and 102, of pulley housing 84. Pulley 82 has a pulley groove 86 around which rope 60 passes. A toothed cam 88 is also rotatably mounted between walls 100 and 102 and has formed at the upper end thereof cam teeth 90 which, upon counterclockwise rotation of cam 88 as viewed in FIG. 5, will become progressively engaged with rope 60 to form a cam tightening engagement therewith to prevent clockwise movement of rope 60 on pulley 82. However, counterclockwise movement of rope 60 on pulley 82 will rotate cam 88 in a clockwise direction releasing the engagement of rope 60 with teeth 90 for rope tensioning as will become evident.

At the lower end of housing 84 is mounted a spring retainer 92 having a spring crevice 94 for receiving one end of elongated finger spring 96. Spring 96 is passed over transverse pin 98 which extends between opposite walls 100 and 102 of housing 84 and is connected thereto. The opposite end of spring 96 is fitted in spring crevice 104 of spring catch 106 formed on cam 88. In this manner, cam 88 is spring urged in a counterclockwise direction, as viewed in FIG. 5, in a cam tightening direction.

The lower end of housing 84 has a transverse opening 110 for receiving the transverse support pin 112 of triangular support 114 which is formed on the end of rod 116. Rod 116 is in threaded engagement with "J hook" 118 which has an upstanding sharpened prong 120 at the exposed end thereof.

Referring to FIGS. 1, 3, and 4, a tent cover 124, which may be of canvas or other suitable tent material, is conical in shape and has flaps 126 along approximately two thirds of the heighth thereof. Flaps 126 are registerable with and fastenable to one another by fastening means such as a zipper to provide a tent enclosure. A tent strap 130 of doubled tent material spans the lower tent perimeter beneath flaps 126 and is fastened to the bottom of cover 120 adjacent to the bottom of cover 120 adjacent the distal ends of staves 22 to provide perimetrical support when flaps 126 are open. Cover 124 is truncated at the top portion thereof to provide an opening therethrough. A conical cap 128 having an open base is insertable over and fastenable to the cover 124 to close the opening as desired. At spaced intervals along the lower perimeter of cover 124, which intervals coincide with the lower ends of staves 22, straps 130 having eyelets 132 and snaps 134 are attached as by sewing to the cover 124. A mating snap 136 is formed on each stave 22 at the lower end thereof to receive in snapped engagement snap 134 after strap 130 has been wrapped over the bottom of stave 22 and eyelet 132 has been inserted over spike 30. Straps 130, and hence cover 124 are thus fastened in snapped engagement to the ends of staves 22. Cover 124 extends about one inch below sections 26 to provide a tent seal with an ice surface before spikes 30 melt in.

In assembly of the embodiment shown in FIGS. 1–5A, the tent stave sections 26 are inserted in sleeves 31 of their respective sections 24. Thus assembled, staves 22 are placed in the proper order so that the openings 48 in bracket arms 46 are aligned to receive pin 64. It is seen that arms 46 of brackets 44 must be angled to provide the stave divergency necessary to form a conical tent shell to support the tent cover as shown in FIG. 1. Washers 70 and 72 are then inserted over ends 66 and 68 respectively, springs 74 and 76 are then inserted over ends 66 and 68, respectively and nuts 78 and 80 are respectively threaded on threads of ends 66 and 68, respectively to resiliently retain brackets 44 in pivotable engagement with pin 64.

Cover 124 is wrapped over staves 22 with straps 130 in registration with the ends of staves 22. Straps 130 are then wrapped under the bottom ends of staves 22, eyelets 132 being inserted over spikes 30 and snaps 134 being pressed into snapped engagement with mating snaps 136 thus forming a tent enclosure. Spikes 30 are then placed in piercing engagement with the supporting surface, which for the embodiment of FIGS. 1–5 is an ice surface. A hole 142 is then formed in the ice surface 143 centrally of the tent enclosure and rope 60, previously attached to eye 58, is threaded around pulley 82 of tensioner 81. Hook 118 is inserted through the hole 142, FIG. 1A, which typically would also be used as the access hole for fishing, and is moved transversely until prong 120 is beneath the underside of the ice surface. The free end of rope 60 is then pulled counterclockwise as viewed in FIG. 5, applying tension to strand **60*a* between pulley 82 and eye 58 causing prong 120 to come into pressured engagement with the underside of the ice. Tension is increased in strand 60*a*, which places compressive forces equally distributed on staves 22, to provide stabilized support for the tent on the ice surface. The tension can be adjusted to accommodate the prevailing weather conditions; for example, under those conditions of high wind forces, a correspondingly higher tension would be applied to strand 60*a*. Cam 88 prevents an unwinding, or counterclockwise movement of pulley 82 due to the engagement of teeth 90 against rope 60. However, on disassembly, spring catch 106 may be pressed downwardly to apply a clockwise rotation of cam 88 to release rope 60 to lessen the tension therein and, in the case of disassembly, to release the tension sufficiently to remove prong 120 from the underside of the ice and lift hook 118 through hole 142**.

Snaps 134 are then unsnapped from their respective mating snaps 136; sections 26 are removed from sections 24; sections 24 are pivoted toward one another, springs 74 and 76 being compressed to that extent necessary to accommodate complete closing of sections 24 against one another to form a compact, easily stored and carried tent in the disassembled condition.

Preferably, the upper portion of cover 24 is permently fastened to the upper ends of staves 22, as by nailing, stapling, or the like, straps 130 being aligned in registration with the lower ends of staves 22 beforehand. This is an aid to erecting, disassembly, and storage of the tent.

When it is desired to construct or erect tent 20 on a ground supporting surface, hook 118 would be replaced by auger 146 as shown in FIG. 6. Auger 146 has a sharpened end 148 and an auger helix 150 formed near end 148 is for advancing auger 146 into holding engagement with the ground upon counterclockwise rotation thereof. Triangular support 152 is formed at the upper end of auger rod 154 and has an upper transverse leg 156 which engages hole 92 of tensioner 81 to provide pivotable support therewith.

In assembly of a tent structure utilizing auger 146, the procedure is the same as that for the embodiment using hook 118 with the exception that auger 146 is turned into holding engagement with the ground prior to insertion of rope 60 through pulley 82. Once auger 146 has been properly inserted into the ground, rope 60 is threaded around pulley 82 and tension is applied to strand **60*a* in accordance with the prevailing weather and wind conditions. A change in tension in strand 60*a* may be accomplished by application of downward pressure to spring catch 106 as described for the embodiment of FIGS. 1–5A.**

An important advantage of the tent structure of this invention when used on an ice surface, is increased ice support for the tent occupants. Hook 118 provides a "lifting" force at the tent center area thereby distributing occupant weight over the entire ice surface under the tent, minimizing ice break-through of an otherwise localized weight on the ice.

While there have been described above the principles of this invention in connection with specific apparatus, it is to be clearly understood that this description is made only by way of example and not as a limitation to the scope of the invention.

What is claimed is:

1. Tent structure comprising:

a plurality of elongate tent staves pivotably connected at one of their respective ends to a common member and supportable at their distal ends to a tent supporting surface;

a tent cover;

means for connecting said cover in supported relation to said staves to define a tent enclosure when said staves are pivoted divergingly from one another;

an elongate tensile strand;

means for connecting one end of said strand to said common member; and said strand adapted to be coupled at its distal end to the supporting surface, said staves being placed in compression upon application of a tensile stress to said strand;

said common member comprises an elongate pin;

each of said staves having a bracket at said one of their respective ends;

each bracket having a pin receiving opening therein;

said pin being inserted through said openings; and means for resiliently compressing said brackets towards one another longitudinally of the pin so that when said staves are pivoted convergingly, said brackets can move longitudinally of and pivotably about said pin.

2. The tent structure according to claim 1 wherein said means comprises at least one helical spring insertable over said pin and acting against said brackets; and fastening means to retain said spring and said brackets in compressed relation on said pin.

3. Apparatus according to claim 1 wherein said last means comprises a J-shaped hook attached to the distal end of said strand and having an upwardly projecting sharpened point for engagement with the underside of an ice surface.

* * * * *